US005417034A

United States Patent [19]

Gabler et al.

[11] Patent Number: 5,417,034

[45] Date of Patent: May 23, 1995

[54] PACKAGING SYSTEM AND METHOD

[75] Inventors: John R. Gabler, Etters; Robert E. Gallagher, Sr., Harrisburg; Joan I. Hersh, Spring Grove; Michael P. Kandolf, I, Newport, all of Pa.

[73] Assignee: The Whitaker Corporation, Wilmington, Del.

[21] Appl. No.: 299,312

[22] Filed: Aug. 31, 1994

Related U.S. Application Data

[63] Continuation of Ser. No. 18,655, Feb. 17, 1993, abandoned.

[51] Int. Cl.[6] ..... B65B 11/58; B65B 13/02; B65B 35/50

[52] U.S. Cl. ..... 53/399; 53/176; 53/447; 53/449; 53/540

[58] Field of Search ..... 53/399, 447, 443, 168, 53/540, 544, 531, 449, 176, 171

[56] References Cited

U.S. PATENT DOCUMENTS

| | | | |
|---|---|---|---|
| 4,802,325 | 2/1989 | Duncan | 53/447 X |
| 4,825,624 | 5/1989 | Calcerano | 53/447 X |
| 4,846,343 | 7/1989 | Rupert | 206/303 |
| 5,140,795 | 8/1992 | Steding | 53/168 |
| 5,220,770 | 6/1993 | Szewczyk et al. | 53/168 X |
| 5,230,206 | 7/1993 | Christ | 53/168 X |
| 5,255,491 | 10/1993 | Marovskis et al. | 53/447 X |

*Primary Examiner*—James F. Coan

[57] ABSTRACT

A system (10) and method of packaging components features stackable internesting trays (54) to carry components (52) in a sequence based upon order of use forming a stack (39) with protective internesting, stackable wrappers (90) and an internal box (36) covered by an external box (16) protecting the components for handling during inventory, shipment, and end use. The trays (54), wrappers (90), and boxes (16, 36) are formed of sheet material and feature access to components as initially loaded with a plurality of boxes oriented upon a shipping pallet (12) to allow access to all components as stacked.

18 Claims, 7 Drawing Sheets

PACKAGING SYSTEM AND METHOD

This application is a continuation of application Ser. No. 08/018,655, filed Feb. 17, 1993, now abandoned.

This invention relates to a packaging system and a method for handling components consumed in the manufacture of a product.

BACKGROUND OF THE INVENTION

In the manufacture of products, such as, vehicles, aircraft, large scale office equipment, copy machines, computers, and other complex apparatus, the usual practice is to manufacture components at a variety of locations, ship such components to an assembly site and assemble the components together to comprise the end product. Components being shipped from the same manufacturing site are bulk packaged for shipment in containers that offer component protection during shipment. The components are removed from their containers at the assembly site, inspected for quality and are inventoried until they are assembled together with other components. The handling of components during this process is highly repetitive and to some extent, wasteful, with both quality control procedures and inspections, as well as loading, unloading, strapping, being performed in repetitive steps between the manufacture of components and eventual use. With respect to larger and more complex products, inventory alone is troublesome with many different part numbers and many different components needed to be consumed in particular sequences during assemblies of the products. With respect to components such as wiring harnesses, used for products such as computers, the problem is aggravated by the difficulty of handling the harnesses, typically made of flexible wire or cable, with fragile connectors on one or both ends, and with the need to distinguish different harnesses appearing similar to one another.

Accordingly, it is an object of the present invention to provide an improved packaging system and method of handling components from a component supplier to the factory floor and use of such components in manufacturing products. It is a further object to provide a packaging system and method that is of improved efficiency in the handling of components, including initial loading in packages for shipment, inventorying, and protection and organization of such components on the factory floor. It is yet a further object to provide an improved system and method of organizing components for use employing the same packages used by a component supplier for the multiple uses of inventory, shipment, and use on the factory floor. It is a specific object of the invention to provide a package that organizes components for use on a factory floor while protecting such components during initial handling, shipment, and subsequent inventory. It is a further object to provide a package that is of low cost to manufacture, allowing the organization of multiple components according to their sequential consumption in assembling a particular apparatus of manufacture.

SUMMARY OF THE INVENTION

The present invention achieves the foregoing objectives through a packaging system and method that features a tray of a configuration to hold a component with the tray having apertures in the top side and tabs in the bottom sides facilitating a stacking of trays in a stable, vertical stack to hold a series of components. Tray sides and a bottom with an open top are of one piece with one of the sides openable to facilitate withdrawal of the component contained in the tray while the tray is in the stack as originally stacked by a supplier of the component. Each tray includes on such side a label, including bar coding information as to the component identity and, if desired, the sequence of use of such component and other information assisting the initial loading of trays and the final unloading of trays for manufacture on the factory floor. The trays are made sturdy enough to not only hold the components being used but to allow a stacking of many trays, one upon the other, some 17 trays being employed in the illustrative example in this application. In accordance with a preferred embodiment of the invention, a wrapper of material, similar to that of the trays, is employed to wrap around a plurality such as four trays, and the wrapper is made to include apertures in the top sides and tabs in the bottom sides so that the wrappers are stackable and internest with the internested stack of trays. The wrappers are made to fold around a plurality of trays with at least one side open to allow access to the trays, particularly to the sides of the trays that are openable to access components contained therein. A plurality of wrappers containing trays are stackable to form an overall stack of components and preferably a set of components that pertain to a particular production step in the production of a product. A stack of components contained in wrappers is fitted into an inner box having a bottom, no top, and four sides with one of the sides having doors or flaps allowing the box to be opened to access the trays and the sides of the trays openable to access components. A given stack of wrappers and trays can be held together in a vertical stack by a suitable binding applied around the stack in a way to allow the sides of trays to be opened. An outer or external box having sides, a top, and no bottom, is dimensioned to slidingly fit over the inner box containing the stack of trays. The outer box can be held through a suitable binding applied around the package in a vertical sense. The invention contemplates a plurality of packages containing the trays, wrappers, inner box and outer box arranged on a platform, such as a pallet, and affixed thereto in a pattern so that upon removal of the outer box, and an opening of the doors of the inner box, access may be had directly to all trays contained therewithin so that the sides may be opened and components withdrawn from the trays as initially stacked, and as shipped. In the event that the number of packages exceeds six, a number such as eight, the platform or pallet is made to receive the packages around the periphery with the opening part of the package facing outside to be readily accessible, the center of the plurality of packages being left unoccupied. In accordance with a further aspect of the invention, a shrink wrap may be applied over the whole plurality of packages and the portions of the pallet to contain the packages for protection from environment, theft, and the like. In accordance with a further aspect of the invention, all of the packaging materials, except for the platform or pallet, including trays, wrappers, inner and outer boxes, can be made of a flat sheet material such as cardboard, suitably cut and formed into the volumetric configurations necessary for the practice of the method of the invention. The sheet material may be secured to facilitate folding of the elements into different volumetric shapes. The platform is preferably made in a pallet configuration to allow the use of forklift trucks or the like, including slings and other means of lifting, to carry a complete plurality of stacks for shipment, handling, and inventory, and in accordance with the invention, the plurality of stacks may be made to contain the components needed for a single product, to be selectively and sequentially used as the product is manufactured through assembly of the components into the frame of the product.

IN THE DRAWINGS

DETAILED DESCRIPTION OF THE INVENTION

Figure 1:
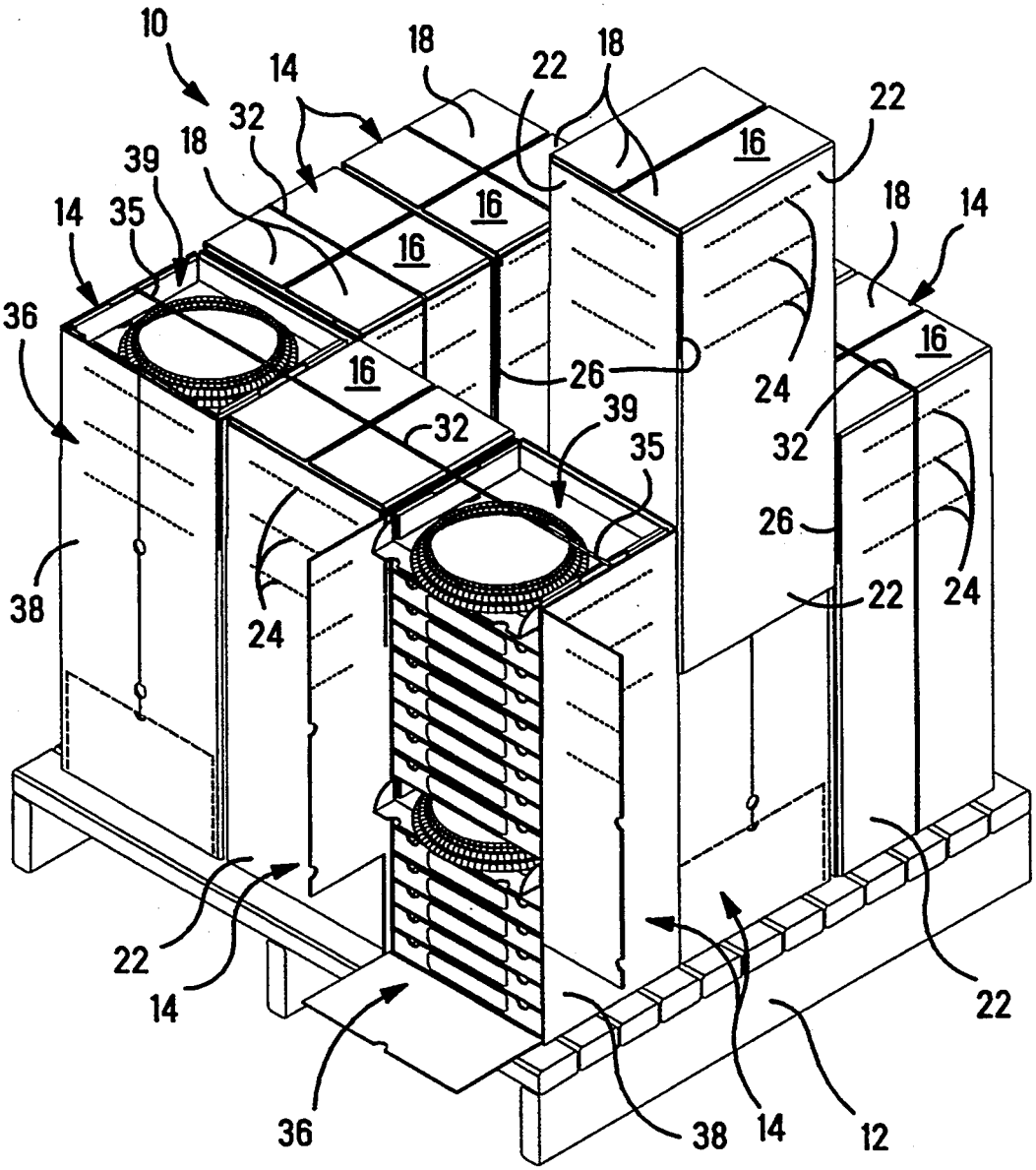
FIGS. 1 and 1A are perspective views showing the invention packaging in the form of eight stacks and various packaging components mounted on a pallet.
Figure 1A:
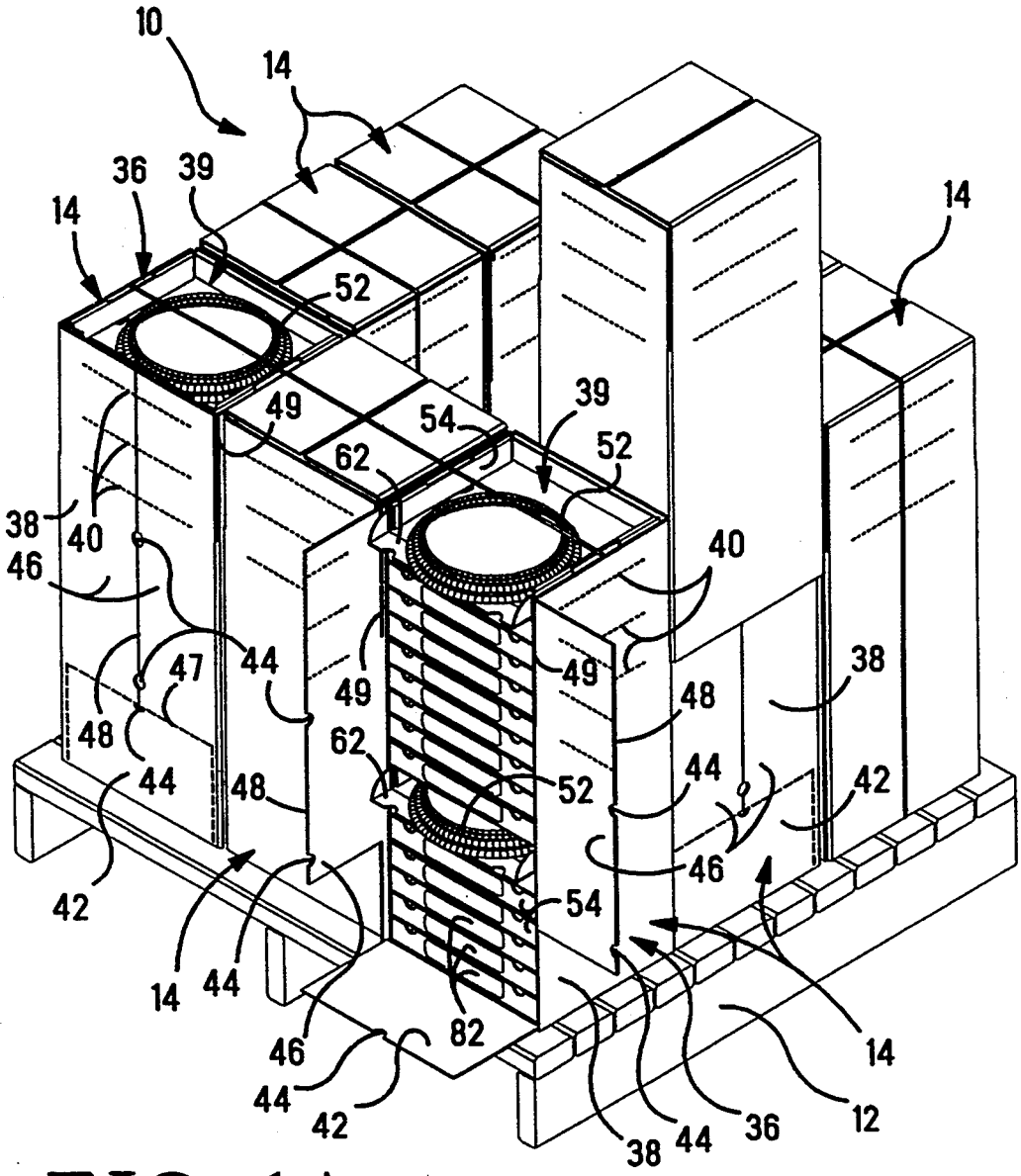
Figure 4:
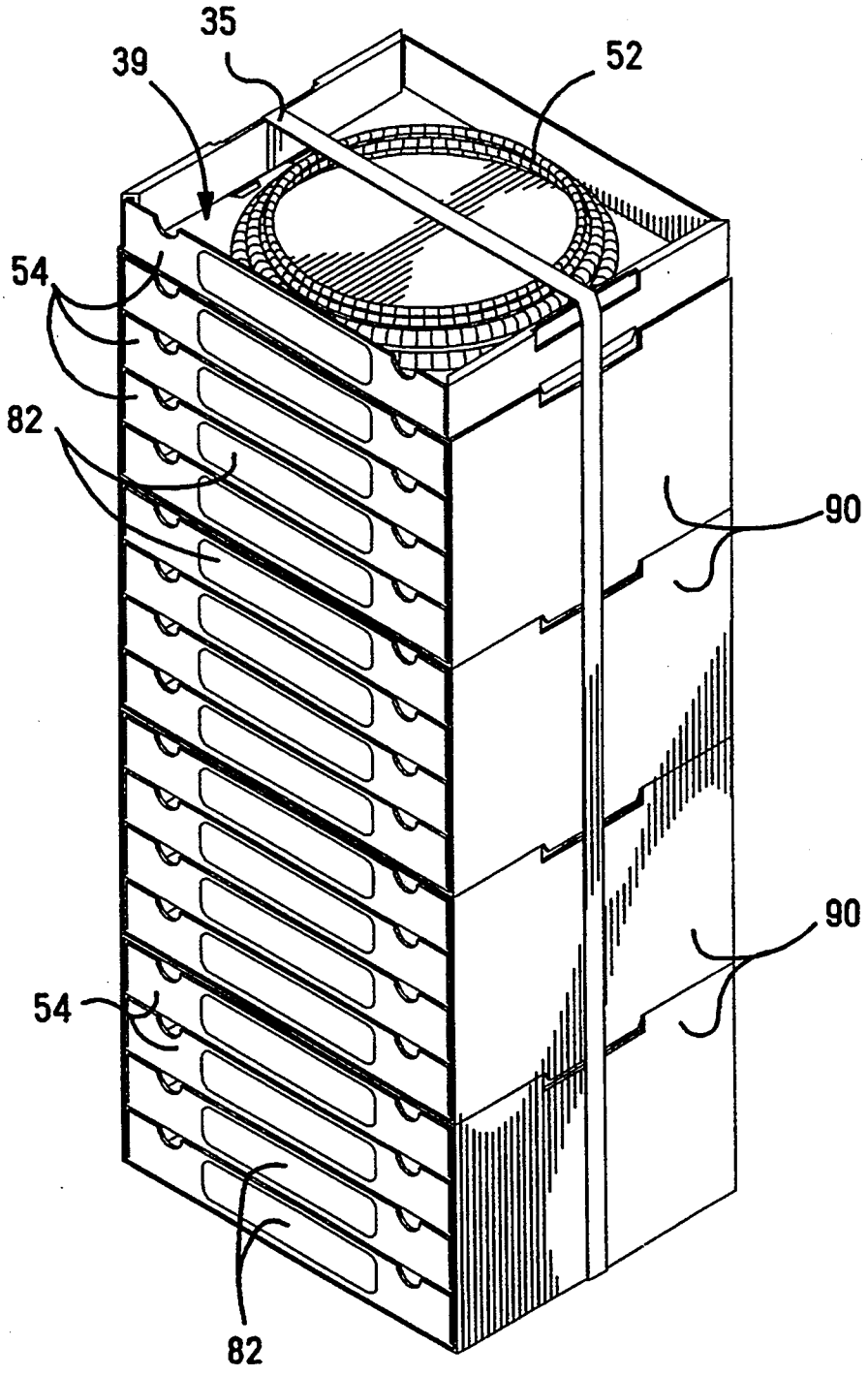
FIG. 4 is a perspective of a stack containing trays and wrappers with a component shown in the top tray.

Referring now to FIG. 1, a packaging assembly 10 is shown to include a platform in the form of a forklift pallet 12 upon which some eight stack packages 14 are supported. The stack packages 14 are each comprised of an outer closed top box 16 that slidingly fits over and receives an inner open top box 36 which in turn contains a vertical stack 39 made up of trays 54 containing components 52 in the form of coiled wiring harnesses. Additionally in a preferred embodiment, sets of trays, four in the illustrative embodiment, are contained within an individual wrapper 90 shown in FIG. 9. As will be described, the trays 54 and the wrappers 90 are made to internest so as to stack vertically in a stable condition. In accordance with the invention concept, the packages 14, including inner stacks 39, are arranged so that the trays 54 are always accessible, portions of the inner boxes 36 that open along sides 38 being made to face outward. The individual outer boxes 16 are held closed by straps shown as 32 in FIG. 1, and the inner stack 39 is held by a strap 35 as shown in FIGS. 1 and 4. Each strap 32 is removed to permit an outer box 16 to be lifted to remove it from an inner box 38. The strap 35 is oriented so as to remain and allow access through a flap 42 and doors 46 to the components 52 within the trays 54. In one aspect of the invention it is contemplated that, the arrangement and number, and sequence in the stack 39, of trays 54, are selected to provide all of the components 52 required for a given product that consumes the component 52. The trays 54 and components 52 are in vertical sequence and suitably marked with labels 82 for identification to facilitate use in sequence. The arrangement of packages 14 is such to facilitate an initial loading of the components 52 into the trays 54 either before or after stacking the trays 54 in stacks 39 with access being provided to the components 52 in the assembly 10. In accordance with the invention, the various packages 14 are secured to the pallet 12, and in one application, a heavy shrink wrap, not shown, is applied over the entire assembly 10 leaving access for a forklift to lift the pallet 12 in a traditional manner.

As can be seen in FIG. 1, an outer, closed top box 16 is made to include a foldable top 18 with sides 22 leading to an open bottom. To be noted are horizontal score or perforation lines 24 that represent a weakening of the sheet material as by scoring or, in the case of corrugated cardboard, by an internal weakening in the corrugation, to make the sides 22 readily foldable along such scoring to adjust the height of the box 16 to correspond to the numbers of trays 54 providing height to the stack 39. Corner edges of the intersecting sides are separated for a portion of the side length, such separation shown as 26. Thus package 16 can be made to have a volume as shown in FIG. 1 or three additional lesser volumes by trimming of the additional material and the top 18, and folding the sides 22 along the score lines 24 and down inside the box 16. As can be appreciated, the dimensions of box 16 are made to accommodate the folding down of the sides 22 and still allow the box 16 to be slid down over the outside of the inner box 36. Outer box 16 thus becomes an open-bottomed sleeve that covers and serves to hold the inner box 36 and other elements together and to protect such elements against displacement and damage. As can be appreciated, following shipment, the outer box 16 can be removed after removing strap 32. Such removal leaves the inner box 36 revealed in the condition shown at the left-most corner of FIG. 1. Thereafter, the inner box 36 can be opened as indicated by the opening of the flap 42 and the doors 46, shown in FIG. 1.

Figure 3:
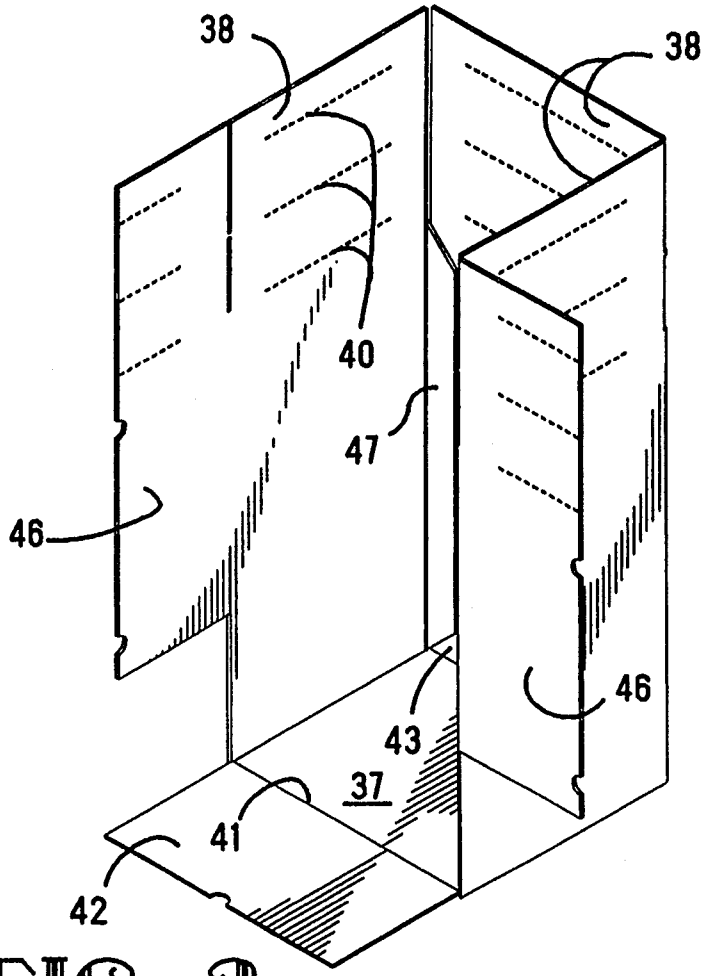
FIG. 3 is a view of the box shown in FIG. 2 with the doors in an open position.
Figure 2:
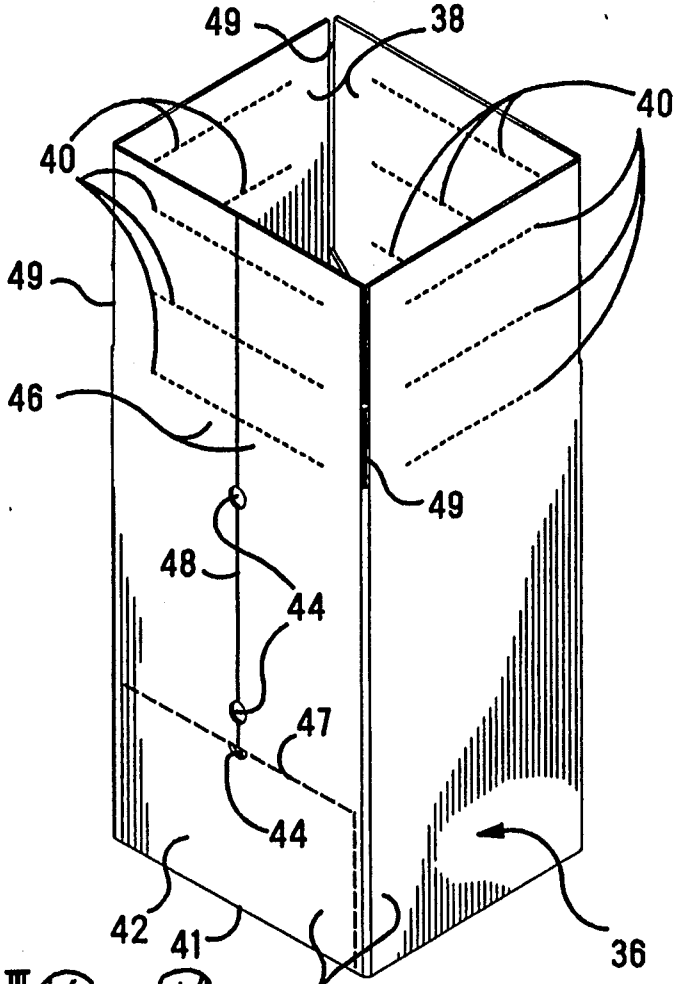
FIG. 2 is a perspective of the inner box employed by the invention.
Figure 5:
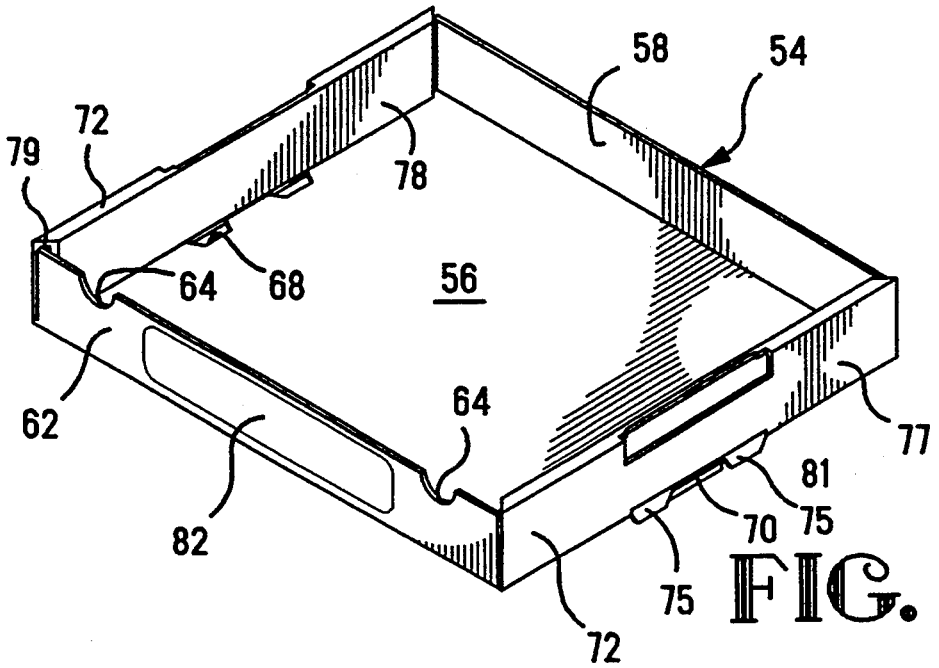
FIG. 5 is a perspective of a tray in its assembled condition.
Figure 6:
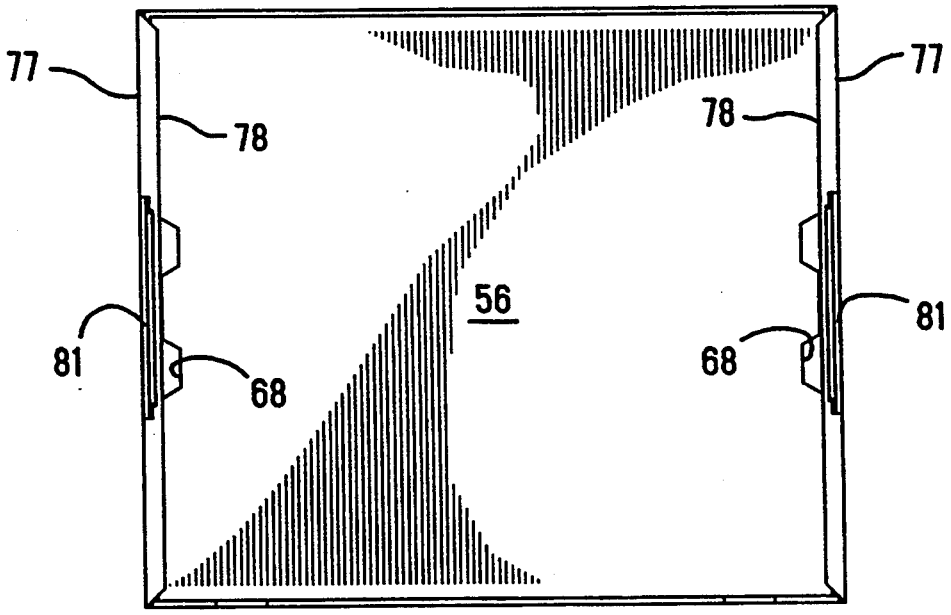
FIG. 6 is a plan view of the tray shown in FIG. 5.
Figure 7:
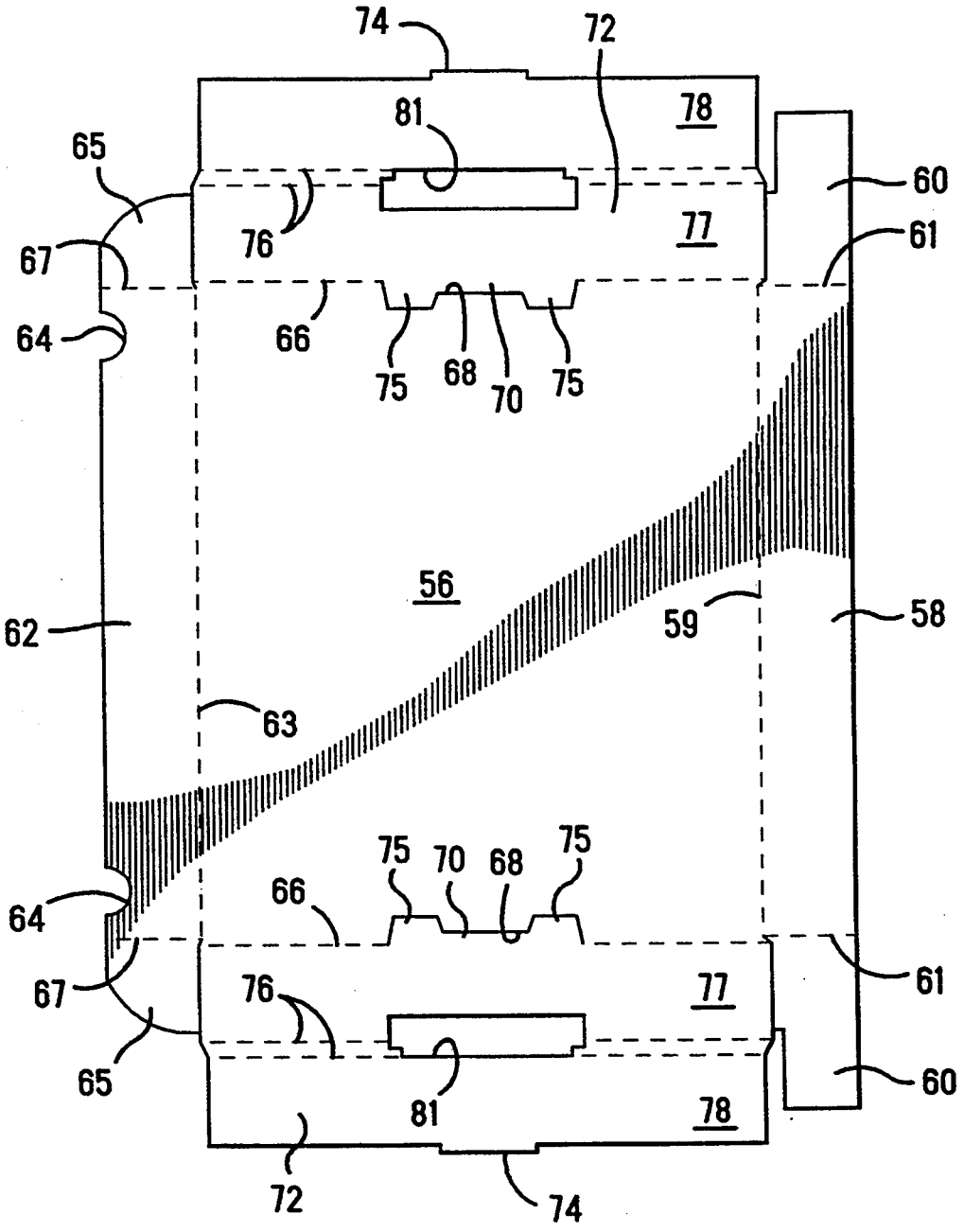
FIG. 7 is a plan view of the blank of the tray prior to being folded and assembled.

Referring to FIGS. 2 and 3, the inner box 36 may be seen to include a bottom 37 and side walls 38 that are scored as at 40 to facilitate changing the volume of the inner box 36 in the manner described with respect to the outer box 16. Inner box 36 in one side wall 38 includes a front flap 42 that is joined flatly to doors 46 by a dotted score line 47, and that drop pivots out and down along corner fold line 41 as shown in FIG. 3 and doors 46 that pivot open outwardly, from an open seam 48 joining the score line 47. Note the access openings 44, in opposing edges of the separation seams 47, 48 of the flap 42 and such doors 46, for facilitating gripping the edges and prying apart the doors 46 and flap 42 to rip the box 36 along the score lines 47 and 48 to open the box 36. Note also that the side walls 38 are separated along open seams 49 along a portion of the side wall length and transverse to score lines 40 sufficient to allow a folding down of sides 38 along the score lines 40 of the material of the side walls downwardly to lie within the box 36. The inner box 36 is made to have an interior volume, considering the possibility of folding down of the side walls to accommodate a reduced number of trays 54 in the inner stack 39 shown in FIG. 4 as a full stack. In a one piece construction, the doors 46 are joined at corners of the box 36 to respective side walls 38, the flap 42 is joined at the bottom corner to the bottom 37, and the rear wall 38, opposite the doors 42 and flap 42, is joined to one of the side walls 38. A glue tab 47 projecting along said side wall 38 is attached to the rear wall 38. A glue tab 43 along the bottom 37 is attached to the rear wall 38. As shown in FIGS. 1 and 4, the trays 52 of the inner stack 39 are made to contain a series of components 52 coiled so as to fit into trays 54 in the inner stack 39. In a manner to be described, a number of the trays 54 stack each with the other and also are contained by wrappers 90 to form the inner stack 39. Referring to FIGS. 5, 6, and 7, the trays 54 will be seen to comprise a bottom 56 with sides 58, 62, and 72. FIG. 7 shows a pattern development of a tray in the flat, profiled as by die stamping, with fold lines indicated by the segmented or dotted score lines shown in the Figure. With reference to FIG. 7, each of the two sides 72 is joined to the bottom 56 by a fold line shown as a dotted line forming a folded corner edge 66 of the tray 54, when the side 72 is folded along the edge 66 to upstand from the bottom 56.

Each side 72 is folded on itself to form double walls, with a pocket between the double walls. With reference to FIG. 7, each side 72 has double fold lines 76 that are parallel to the corner edge 66. The side 72 is folded twice on itself along both of the fold lines 76. In doing so, the side 72 becomes double walled, with two walls 77, 78, FIGS. 5 and 6, and a pocket 79 formed between the two walls 77, 78. A tab 74 projects outwardly from the top edge of the side 72. When the side 72 is doubly folded on itself, the tab 74 will project into the slit 68 in the bottom 56 of the tray 54. The tab 74 interlocks with the bottom 56 to hold the two walls 77, 78 next to each other.

With reference to FIG. 7, the side 58 is joined the bottom 56 of the tray 54 by a fold line that becomes a bottom corner edge 59 when the side 58 is folded to upstand from the bottom 56. Tabs 60 project from the lateral extremities of the side 58, and are folded inward along fold lines 61 forming side corner edges of the tray 54. The tabs 60 are inserted into respective pockets formed by the double walled sides 72, as the sides 72 are being doubly folded. The tabs 60 are longer than the height of the pockets in the sides 72, such that the tabs 60 can not be withdrawn from the pockets by pivoting the side 58 relative to the bottom 56 of the tray 54. Thereby, the tabs 60 and the side 58 interlock with the sides 72 to remain upright and upstanding from the bottom 56 of the tray 54.

The side 62 is joined to the bottom 56 of the tray 54 by a fold line that becomes a bottom corner edge 63 when the side 62 is folded to upstand from the bottom 56 of the tray 54. Tabs 65 on opposite lateral extremities of the side 62 are folded along fold lines 67 which become side corner edges of the tray 54, when the tabs 65 are inserted into the pockets formed by the double walled sides 72. Each tab 65 has an arcuate edge and is not longer than the height of the pocket. Such a construction allows each tab 65 to pivot and withdraw from the pocket, when the side 62 is pivoted about the bottom corner edge 63 that serves as a hinge for this purpose. The side 62 is a door that is closed by the tabs 65 inserted in the pockets, the side can be pivoted like a door, about the bottom corner edge 63, to open the side 62 of the tray 54, gaining access to the component 52 in the tray 54, even while the tray 54 remains in the stack 39 and bound by the strap 35. Edge openings 64 on the top edge of the side 62 will allow the edge to be exposed for gripping so as to grip and swing open the side 62.

With reference to FIG. 7, a slit 68 in the bottom 56 has opposite ends that intersect, and end at, the dotted line forming the folded corner edge 66. When the side 72 is folded along the fold line 66 to upstand from the bottom 56, the slit 68 forms a tab 70, FIG. 5, that is pivoted out of the plane of the bottom 56 of the tray 54, and that projects downwardly beyond the bottom 56 of the tray 54. Two projecting legs 75 are on the lateral extremities of the tab 70.

Figure 8:
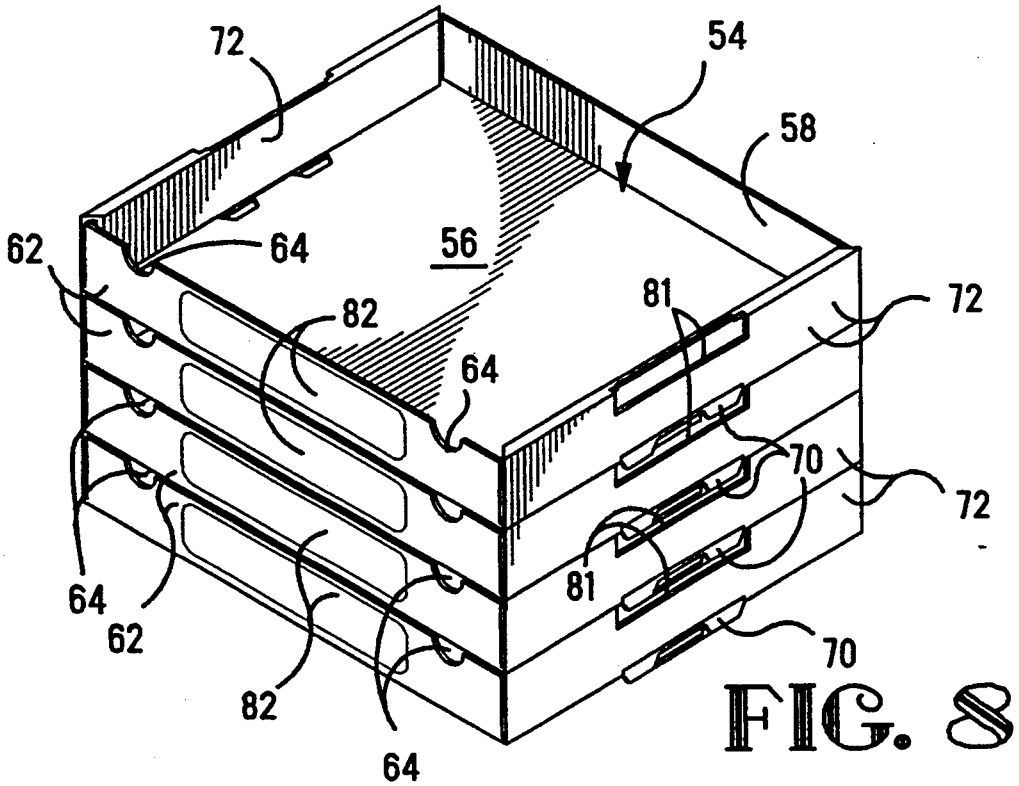
FIG. 8 is a stack of four trays, shown in perspective.

With reference to FIG. 7, a closed end slot 81 in each side 72 is intersected by the double fold lines 76. The slot 81 extends along and in the outer wall 77, FIG. 5, to serve as a receptacle for a tab 70 of another tray 54 stacked on top, FIG. 8. The trays 54 are stacked with the sides 58 one on the other, the sides 62 one on the other, and the sides 72 one on the other. The slot 81 has inwardly stepped lateral edges providing a restricted width where it extends along the top edge of the doubly folded side 72. The edges of the slot along the restricted width bias the tab 70 of the stacked other tray 54 outwardly. Since the tabs 70 of the stacked tray 54 are on opposite sides, the tabs 70 are biased outwardly in opposite directions when received in respective slots 81 of a tray 54 below. This prevents the stacked trays 54 from internesting, one into the other, and from collapsing and shifting while in the stack.

Figure 9:
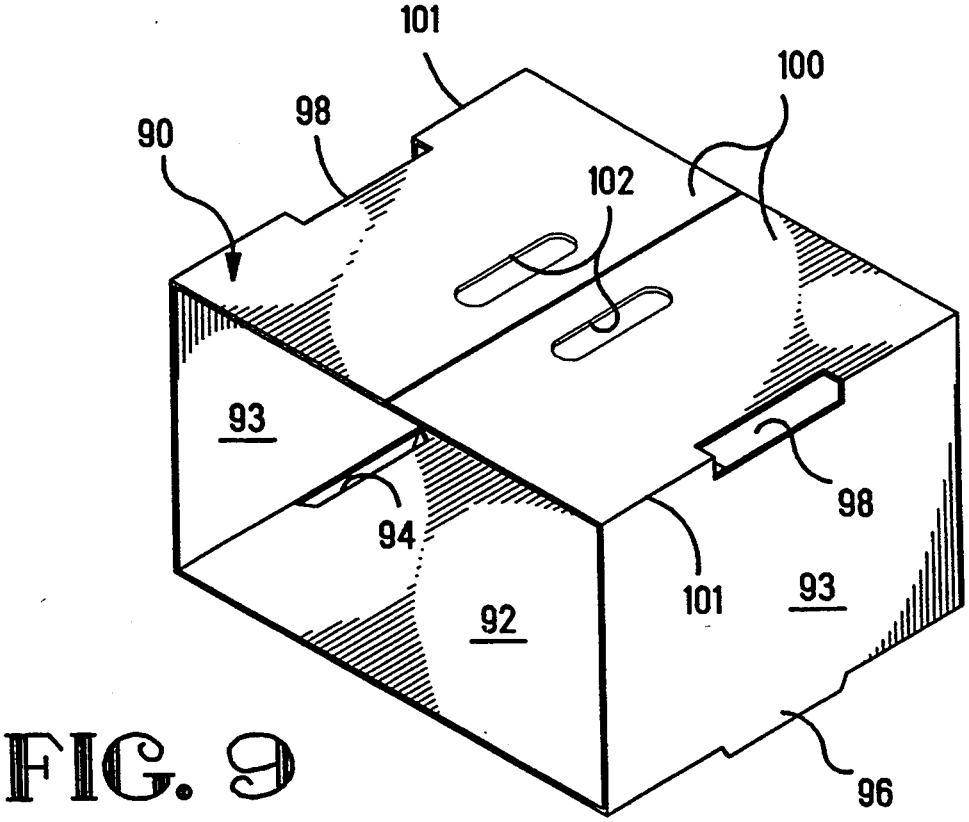
FIG. 9 is a perspective of a wrapper in accordance with the invention packaging concept.

With reference to FIG. 9, the wrapper 90 comprises, a floor 92 having at the folded, upstanding sides 93 apertures 94 forming tabs 96 that extend downwardly in the plane of respective sidewalls 93, and with further apertures 98 partially within the sidewalls 93, and partially within top flaps 100 folded along corner edges 101. The flaps 100 have apertures 102 therein to facilitate an opening of the wrapper and handling. To be appreciated are the positions of tabs 96 and apertures 98 that allow an internesting in stacking of wrappers 90 and also an internesting with trays 54 inside the wrappers 90, the projections or tabs 74 of the trays 54 fitting into the apertures 94 left by folding out tabs 96. FIG. 4 shows an inner stack 39 with four wrappers each filled with four trays with an additional tray on top and, as mentioned, with a strap 35 holding the inner stack together. In accordance with the invention concept, the trays may be marked for identification with respect to components by bar code or other labels 82, on the sides 62 serving as doors to the trays 54 loaded individually, stacked in stacks of four with an appropriate wrapper placed therearound and with an inner stack formed of the resulting stacks of trays and wrappers to accommodate a phase of production assembly. Inner stacks may be organized upon a platform in accordance with the needs of a product; namely, all of the components necessary for a given product placed in the several stacks with the stacks oriented to facilitate access to the components in an appropriate sequence of use by first removal of the inner and outer boxes and an opening of the trays through the sides in the manner described.

The invention contemplates a distinct utility for the individual trays in their internesting and stacking during a loading phase and use with a given inner stack for the same purpose of organization as well as the organization of trays, wrappers, inner and outer boxes forming stacks for shipping. The invention method utilizes the packaging thus described, or the equivalent thereof, so oriented to be accessible during loading and during end use is fully contemplated.

The invention, in a preferred embodiment, is made of corrugated cardboard suitably die stamped and formed into the configuration shown. The invention contemplates that other possible uses of the invention employing other types of paper or plastic packaging materials formed to include the internesting and stackable features. The invention also contemplates different ways of providing tie-downs for the stacks and other types of platforms other than the pallet construction shown.

Having now described the invention relative to drawings thereof in a preferred embodiment, claims are appended intended to define what is deemed to be inventive.

We claim:

1. A packaging system for initial loading, shipping, inventory and final use of a series of components used in the assembly of a product, comprising: a series of trays each accommodating a component placed therein, a top and a bottom of each of the trays having apertures in the top and tabs on the bottom to facilitate an internesting to form a relatively stable stack of the trays, each said tray having at least one openable side facilitating component insertion and withdrawal, and a protective covering adapted to cover a stack of the trays loaded with components for shipment, said protective covering being formed to provide a box-like structure and being removable to allow access to the stack of the trays, and to the openable sides of the trays to allow opening of the openable sides and component withdrawal for use in production.

2. A packaging system as recited in claim 1 wherein, said trays are each formed of flat sheet material cut and formed to provided a box-like structure having an open top, sides, and a bottom, with one of said sides being said openable side.

3. A packaging system as recited in claim 1 wherein, said trays and said protective covering are each formed of flat sheet material cut and formed to provide a box-like structure, the trays each having an interior volume accommodating a component, and with a set of the trays fitted interiorly of the protective covering.

4. A packaging system as recited in claim 1 wherein, said protective covering comprises, foldable wrappers adapted to receive the series of trays internested, stacked and fitted therein, a top and a bottom of each of said wrappers having apertures in the top and tabs on the bottom to facilitate a stacking of multiple wrappers each containing a stack of the internested trays with one side of the wrappers open and with the trays oriented with the openable sides thereof to facilitate withdrawal of components from the trays while fitted within the wrappers.

5. A packaging system as recited in claim 1 and further comprising: a plurality of stacks of the trays each stack being covered by a separate protective covering, and a platform with said stacks affixed thereto for shipment and use during production of said product.

6. A packaging system as recited in claim 1 wherein, the protective covering comprises; a box-like structure having an open top, sides, and at least one door on one of the sides, and an interior volume to receive a stack of the trays and allow access through said door to interiors of said trays through the openable sides of the trays.

7. A packaging system as recited in claim 1 wherein, the protective covering comprises; a box-like structure having a top, sides, and an open bottom, and an interior adapted to slidingly fit over a stack of the trays to hold said stack together.

8. A packaging system as recited in claim 1 wherein, the protective covering comprises; wrappers adapted to wrap around respective stacks of the trays, an inner box adapted to hold a stack of said wrappers around said trays, and an outer box adapted to slidingly fit over the inner box, features on the inner box to facilitate access to the trays for component removal and with the outer box precluding access to said trays.

9. A packaging system as recited in claim 1 wherein, the protective covering is formed of flat material having been stamped and cut and formed, and selectively foldable portions of the material adapted to alter the interior volume of the protective covering by selectively folding the foldable portions of the material.

10. A packaging system as recited in claim 1 wherein, the covering comprises, weakened portions along lines of the covering to permit folding of the covering along said lines.

11. A packaging system as recited in claim 1 wherein, The system of claim 10 wherein the said means includes multiple lines to provide at least several volumetric configurations for said protective means.

12. A package comprising: a series of trays, each of the trays being adapted to hold a component, each tray having a bottom and four sides, with one of said sides being an openable side to access a component within the tray, said sides having tops and bottoms, at least two of said sides having apertures in the top and tabs in the bottom facilitating an internesting of the trays, with the tabs of one said tray fitting into the apertures of another said tray so that the trays are stacked in a series of trays one upon the other, an inner box adapted to receive a stack of the internested trays, he box having at least one door accessing said trays from a side of the box, the trays being oriented with the openable sides facing toward the door, an outer box slidably fitted over the inner box and the trays, the trays and the components therein being protected for shipment.

13. A packaging system for initial loading, shipping, inventory and use of a series of components for assembly of a product, comprising: a series of trays containing the series of components, the trays being arranged in stacks, the trays being adapted with a construction to facilitate stacking of the trays, with each said tray having a side being openable to access a component therewithin while the tray is in a stack, and a series of outer protective boxes adapted to slidingly fit over respective stacks, and said boxes being secured to a common support for shipment and use of the components.

14. A method of handling components that are used in the manufacture of a product, including the steps of:

a. loading each of the components into a corresponding tray, each of the trays being openable while in a stack of the trays to remove the component for use, b. stacking multiple trays in an order corresponding to an order of removing the components from the trays for use in manufacturing a product, c. arranging multiple stacks of trays adjacent to one another on a platform, and d. covering said trays and said stacks with a protective material and binding said stacks together for shipment to a manufacturer for use in manufacturing a product.

15. The method of claim 14 and further comprising the steps of: loading coiled harnesses into respective trays prior to covering the trays.

16. The method of claim 14, and further comprising the steps of: adapting the trays with openable sides, and adapting the trays for opening the openable sides while in a stack of the trays.

17. The method of claim 14 and further comprising the steps of: adapting the trays with openable sides, adapting the trays for opening the openable sides while in a stack of the trays, and orienting the trays with the openable sides facing in a common direction to facilitate access to the components in the trays.

18. The method of claim 14 including affixing said stacks to a pallet.

* * * * *